United States Patent [19]

Maher

[11] Patent Number: 4,652,014

[45] Date of Patent: Mar. 24, 1987

[54] RAPID, LOW COST INFORMATION RETRIEVAL APPARATUS

[75] Inventor: Thomas P. Maher, Burlington, Mass.

[73] Assignee: Polaroid Corporation, Cambridge, Mass.

[21] Appl. No.: 294,619

[22] Filed: Aug. 20, 1981

Related U.S. Application Data

[63] Continuation of Ser. No. 114,063, Jan. 21, 1980, abandoned, which is a continuation of Ser. No. 974,251, Dec. 29, 1978, abandoned.

[51] Int. Cl.[4] ..... B42F 21/00

[52] U.S. Cl. ..... 283/36; 116/234; 283/1 A; 283/42; 283/43; 434/219; 434/368

[58] Field of Search ..... 116/234, 306, 202, 307; 35/9 R, 9 B, 13, 54; 116/316, 317, 319, 327; 283/4, 1 A, 37, 37.5, 36, 38, 39, 41, 42, 43; 340/286 M, 525, 365 VL, 755, 752, 715; 434/219, 224, 368

[56] References Cited

U.S. PATENT DOCUMENTS

| | | | |
|---|---|---|---|
| 121,561 | 12/1871 | Ward | 116/202 |
| 1,121,486 | 12/1914 | Evans | 116/316 |
| 1,525,796 | 2/1925 | Bliss | 116/316 |
| 1,707,061 | 3/1929 | Lewis | 283/1 A |
| 1,852,881 | 4/1932 | Gray | 283/36 |
| 2,627,125 | 2/1953 | Finegan . | |
| 2,681,655 | 6/1954 | Schade | 116/234 |
| 3,146,533 | 9/1964 | Carmody . | |
| 3,298,714 | 1/1967 | Celmer | 116/234 |
| 3,310,025 | 3/1967 | Egner | 116/317 |
| 3,324,823 | 6/1967 | Peters | 116/234 |
| 3,688,414 | 9/1972 | Koehlinger et al. | 434/219 |
| 3,894,346 | 7/1975 | Ward . | |
| 4,231,168 | 11/1980 | Nippel | 434/368 |

FOREIGN PATENT DOCUMENTS

| | | | |
|---|---|---|---|
| 1501853 | 10/1967 | France | 283/4 |

*Primary Examiner*—Charles Frankfort

*Attorney, Agent, or Firm*—John J. Kelleher

[57] ABSTRACT

Low cost, easily updated information retrieval apparatus is provided that will provide rapid access to information relating to the probable cause of an apparent or actual process or other machine malfunction signalled by an indicating device, and a recommended action to correct such malfunction.

13 Claims, 4 Drawing Figures

RAPID, LOW COST INFORMATION RETRIEVAL APPARATUS

This is a continuation of application Ser. No. 114,063, filed Jan. 21, 1980, now abandoned, which is, in turn, a continuation of application Ser. No. 974,251, filed Dec. 29, 1978, now abandoned.

BACKGROUND OF THE INVENTION

1. Field of the Invention

The present invention relates to apparatus for the low cost, rapid retrieval of information relating to a plurality of variable quantities that have their status or condition displayed by a plurality of visual indicators having a particular positional relationship with respect to one another, in general, and to such apparatus for the retrieval of information relating to process control or other equipment, in particular.

2. Description of the Prior Art

A variety of equipments in general and certain process machinery in particular, are often provided with a plurality of indicators that visually indicate the status and/or condition of certain variable quantities that are either within or are associated with said equipments. As a result of the limited space that is alloted to visual indicators on a particular piece of equipment, normally only minimal information is provided on or near such indicators to explain the meaning associated with an indication by a particular variable quantity displaying visual indicator. Placing a sizable amount of information on, or in relatively close proximity to, a particular visual indicator is normally impracticable due to said space limitation.

If a machine operator is thoroughly familiar with the operation and/or servicing of a particular machine, a minimum amount of information on or near the visual indicators displaying the status and/or condition of certain variable quantities essentia to proper machine operation would normally be adequate. However, a novice machine operator not familiar with the operation of such a machine will need ready access to relatively detailed, machine operating and servicing information. In the case of process machinery in particular, a delay in obtaining such information can be costly in terms of reduced machine output or lost production One arrangement that would provide rapid ready access to visual indicator related machine operating and/or servicing information could be a computer with a video display where all of the necessary operating and servicing information relating to said indicator is stored in said computer for subsequent viewing on said video display. The information could either be manually selected for viewing on the video display by a machine operator or the information could be automatically selected for viewing on said video display in response to an indication by the indicator to which such information relates. In either case, the equipment associated with this particular type of information retrieval, and the updating of such information is relatively costly. Other information retrieval apparatus that provide relatively rapid access to necessary machine operating and servicing information necessarily entails a substantial equipment acquisition and information updating cost penalty. Information retrieval apparatus that does not provide the necessary rapid access to information will produce increased production costs because of the increase in information retrieval time.

SUMMARY OF THE INVENTION

In accordance with the teachings of the present invention, low cost, easily updated, expeditious information retrieval apparatus is provided for use with a plurality of visual indicators having a particular positional relationship with respect to one another where said indicators display the status and/or condition of certain variable quantities that are associated with a particula piece of machinery or equipment. The information retrieval device comprises a plurality of movably positioned sheets of material with each of said sheets having an associated index that resembles a particular visual indicator, said sheets having information located thereon that relates to the particular visual indicator that its associated index resembles. In addition, the positional relationship of sheet indices is substantially the same as the positional relationship of the visual indicators that they resemble. In one embodiment, the information is removably mounted on the movably mounted sheets so that said information can be readily updated.

DESCRIPTION OF THE PREFERRED EMBODIMENTS

Figure 1:
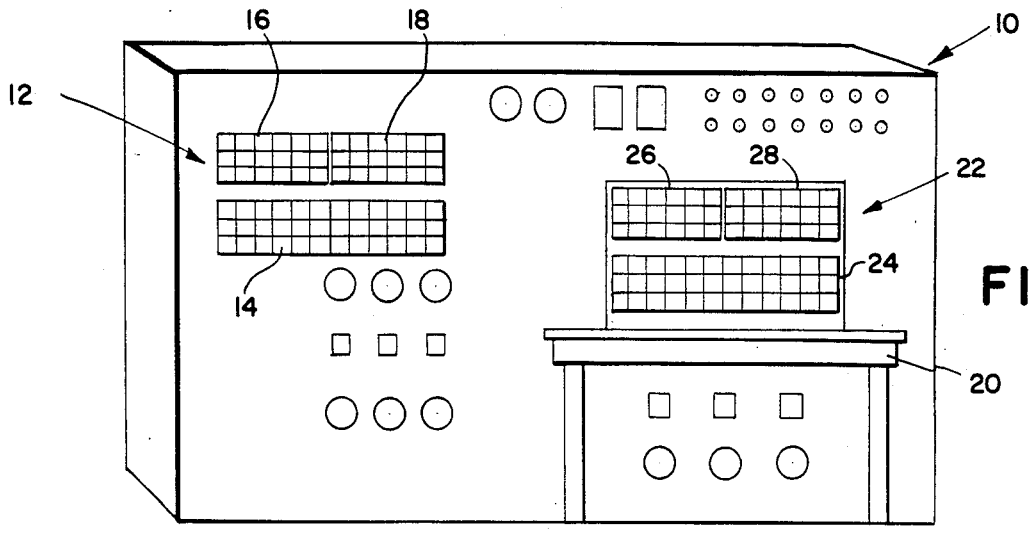
FIG. 1 is a perspective view of a processing machine having a plurality of visual indicators for monitoring certain variable quantities associated with said machine and a three-section information retrieval device incorporating the inventive concept of the present invention, said device being positioned on a table immediately in front of said machine.

Referring now to the drawings, and specifically to FIG. 1 a perspective view of film processing machine 10 having a plurality of visual indicators 12, arranged in three sections, displaying the condition and/or status of certain variable quantities associated with said processing machine 10, is depicted. Film processing machine 10 processes and packages instant developing film of the type sold by the Polaroid Corporation under the registered trademark SX-70, said processing and packaging being performed in three relatively distinct machine sections. In the first section, the components of a film unit or frame that will eventually form a finished photographic print are laminated or are otherwise assembled into such a frame. A plurality of variable quantities associated with this laminating and assembling process are monitored by conventional monitoring means and their condition and/or status are displayed by the plurality of indicators included in section 14 of visual indicators 12 on film processing machine 10. In the second section of processing machine 10, the completed film frames from said first section are assembled into ten film frame packs that include such things as a housing, a battery, and a film frame positioning biasing spring. A plurality of variable quantities associated with the film pack assembly section are monitored by conventional means similar to the monitoring means in section one and their condition and/or status are displayed by the plurality of indicators included in section 16 of visual indicators 12 on film processing machine 10. In the third section of film processing machine 10, each assembled film pack is placed in its own individually sealed package. As in the first and second sections of film processing machine 10, a plurality of variable quantities associated with the film packaging section are monitored by conventional monitoring means and their condition and/or status are displayed by the plurality of indicators included in section 18 of visual indicators 12 on said film processing machine 10.

Table 20 is located in a position immediately in front of processing machine 10 in fairly close proximity to visual indicators 12, the top surface of said table 20 being in a generally horizontal plane. Information retrieval apparatus 22, incorporating a preferred embodiment of the present invention, is positioned immediately on top of said table 20. Information retrieval apparatus 22 comprises a plurality of sheets of plastic material divided into three spaced apart groups 24, 26 and 28, with each plastic sheet having one pivotally mounted edge and having the edge that is opposite from said pivotally mounted edge elevated above said pivotally mounted edge. All the sheets of material included in said information retrieval apparatus 22 are preferably oriented such that they are normally parallel to a plane that forms an angle of approximately 60° with respect to the horizontal top surface of said table 20.

As briefly mentioned above and as illustrated in FIG. 2, each of the plastic sheets of material included in information retrieval apparatus 22 are subdivided into three spaced apart groups 24, 26 and 28, and are pivotally mounted at their lower edge by metal ring-type binders 30, 32 and 34, respectively. Ring-type binders 30, 32 and 34 are mounted in a fixed position with respect to backward sloping support stand 36. The plastic sheets of material are pivotally mounted so that they can be readily moved outward and downward for rapid information retrieval without disturbing the sequence in which they are arranged.

Figure 2:
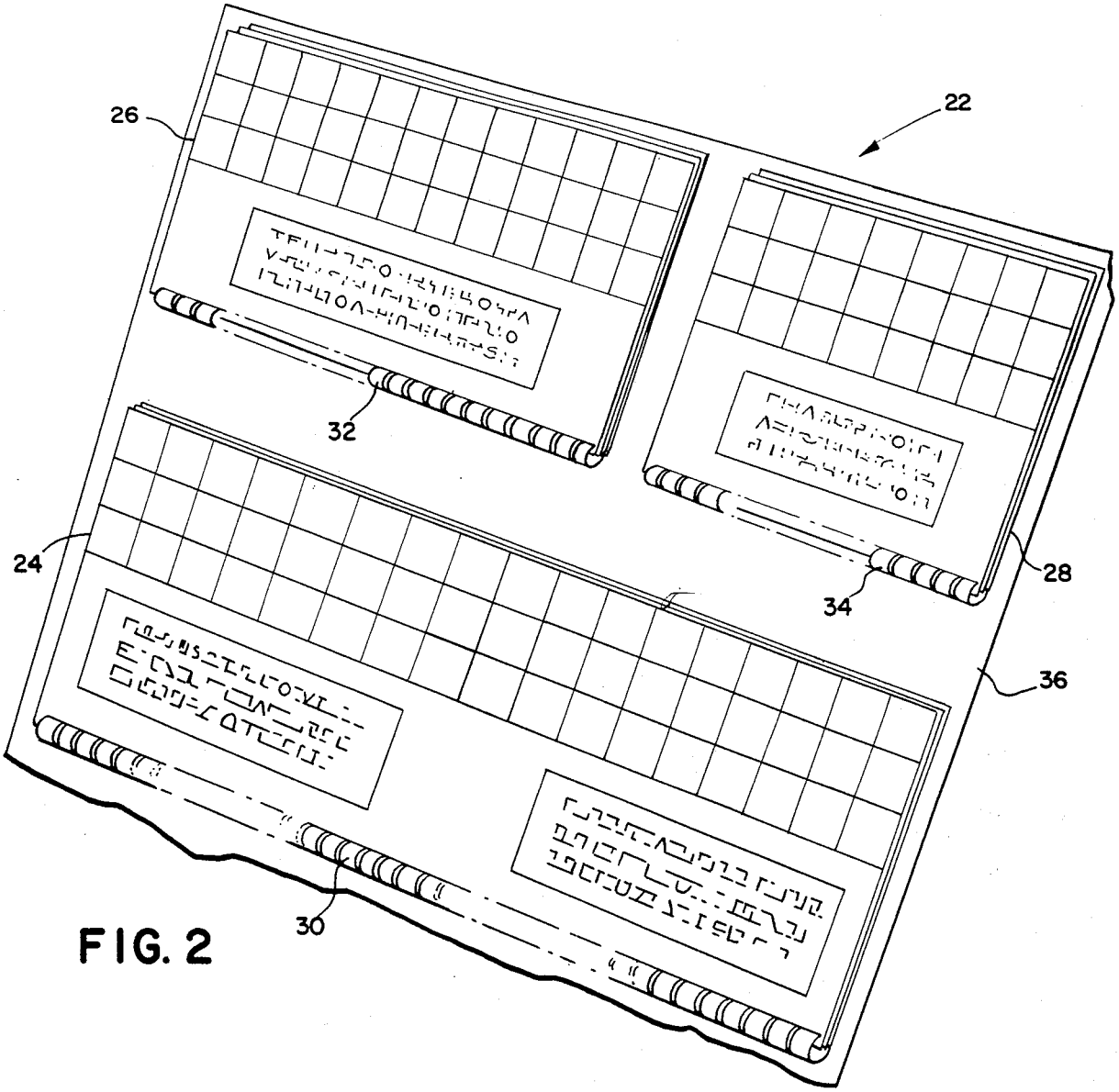
FIG. 2 is an enlarged perspective view of the three-section information retrieval device depicted in FIG. 1.
Figure 3:
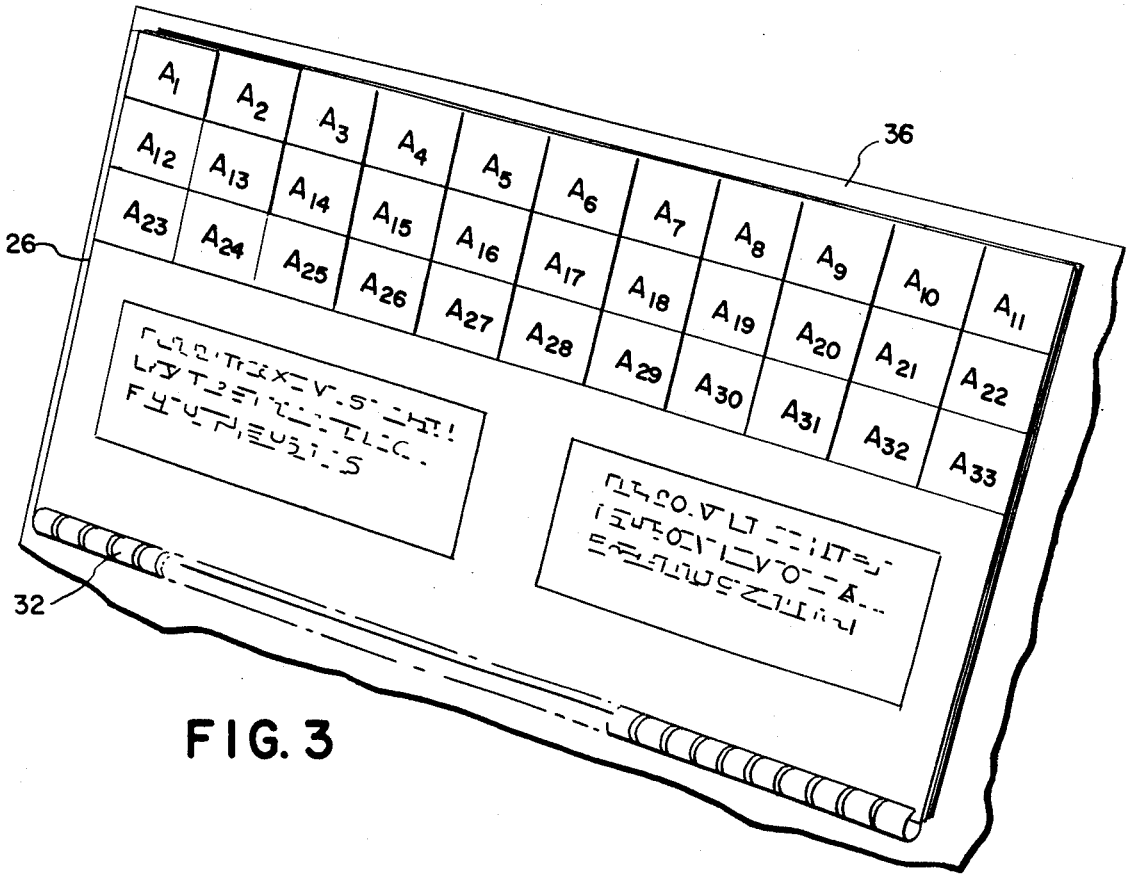
FIG. 3 is an enlarged elevational view of one section of the three-section information retrieval device depicted in FIG. 2.

When all of the sheets of material mounted on support stand 36 are pivoted upward into a normal or stored position, each of said sheets of material has a sheet locating index tab projecting upwardly therefrom as illustrated in both FIGS. 2 and 3. In FIG. 3, to which reference is now made, all of the plastic sheets of material included in sheet group 26 mounted on support stand 36 by ring-type binder 32, are shown in greater detail. The index tabs in said group 26 are, in this particular application, thirty-three in number, are for convenience of description labeled $A_1$–$A_{33}$ and are arranged in a row and column matrix making all of said index tabs viewable simultaneously. Each of said index tabs projects upward from a single sheet of plastic material and collectively, these thirty-three sheets form said group 26.

Figure 4:
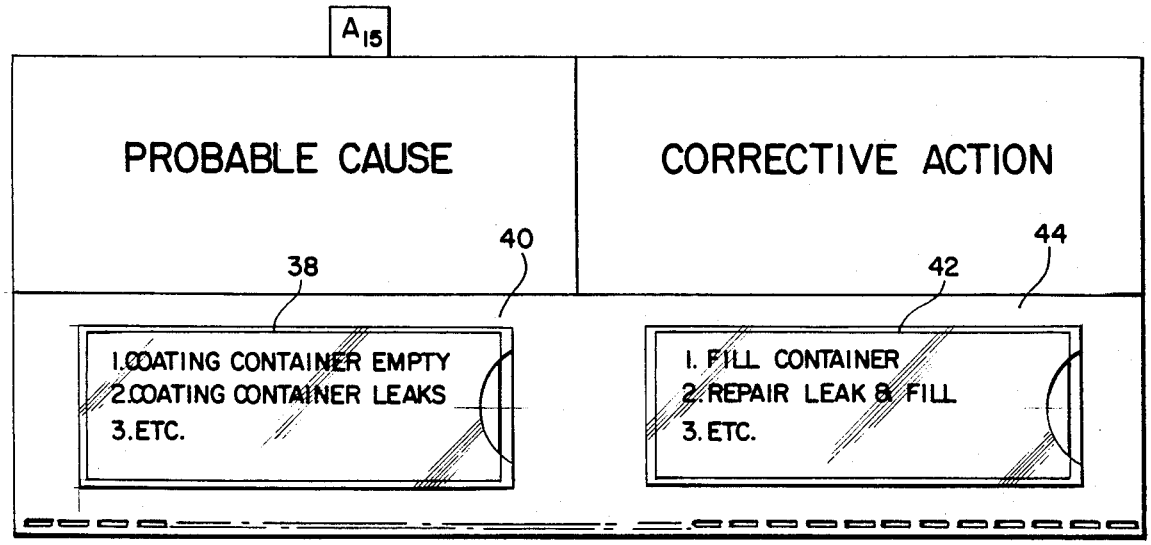
FIG. 4 is a front elevational view of a single sheet of material with its projecting index tab, with said sheet of material having information thereon relating to a particular visual indicato

Every sheet in sheet group 26, as well as all of the sheets in the other sheet groups of information retrieval apparatus 22, has information located thereon that relates to its upward projecting tab. A detailed view of sheet $A_{15}$ only, one of the sheets of material in said sheet group 26, is shown in FIG. 4. Normally, the index tab projecting upward from sheet $A_{15}$ would contain more specific information relating to its associated visual indicator. The information on sheet $A_{15}$ in FIG. 4 in this particular information retrieval application, is divided into two major categories. One category is the probable cause of a potential or actual malfunction associated with processing machine 10 and the other category is the recommended action to rectify said malfunction. Information relating to the probable cause of said malfunction is contained on readily removable card 38, said card 38 being mounted on sheet $A_{15}$ by clear plastic sheet member 40. Mounting member 40 is generally rectangular in shape with three of its four edges being attached to sheet $A_{15}$. The fourth edge of member 40 is not attached to sheet $A_{15}$ so that card 38 can be inserted between member 40 and sheet $A_{15}$. Card 38 can be readily removed if the information on said card 38 needs updating. Information relating to the recommended action to correct a malfunction is contained on card 42, said card 42 being mounted on sheet $A_{15}$ by clear plastic sheet member 44. Mounting member 44 is generally rectangular in shape with three of its four edges also being attached to sheet $A_{15}$. The fourth edge of member 44 is not attached to sheet $A_{15}$ so that card 42 can be inserted between member 44 and sheet $A_{15}$. Card 42 can also be readily removed for updating if such updating should become necessary.

Each of the upwardly projecting index tabs described with respect to information retrieval apparatus 22 in FIGS. 1–4 has a corresponding visual indicator in the plurality of visual indicators 12 on film processing machine 22 depicted in FIG. 1, that it very closely resembles. In addition, the positional relationship of an image of all of the index tabs of information retrieval apparatus 22 would be the same as the positional relationship of an image of all of the visual indicators forming the plurality of visual indicators on film processing machine 22 in said FIG. 1 if said images were projected onto a reference plane. If a potential or actual malfunction should occur in film processing machine 22 that results in a visual indication by one of the visual indicators in the plurality of indicators 12 on film processing machine 22, a machine operator would immediately be directed to information describing the probable cause of said malfunction and a recommended corrective action, by first observing the physical position and appearance of the visual indicator that is signalling the visual malfunction signal and then looking for an index tab in information retrieval apparatus 22 that both closely resembles and has the same positional relationship with respect to the remaining index tabs as does the indicating visual indicator with respect to all of the other non-indicating visual indicators. When the appropriate tab is located, the machine operator moves said tab away from support stand 36 (FIG. 2) to the point where all of the pivotally attached sheets of material in front of said index tab and its associated sheet of material pivot downward from the force of gravity to thereby render the information on the sheet of material associated with said corresponding index tab viewable to a machine operator. Once the information on the exposed sheet has been read by the machine operator and the potential or actual malfunction has been corrected, all the sheets of material in information retrieval apparatus 22 (FIGS. 1–4) are returned to their normal upright positions so that said apparatus 22 is in the proper condition for subsequent information retrieval.

GENERAL CONSIDERATIONS

The upwardly projecting index tabs described in the preferred embodiment of the present invention need not be in the form of a tab projecting from its associated information sheet or even form a part of such a sheet so long as the indexing device resembles its associated visual indicator and the above-described positional relationship of said indexing device is maintained. The information sheet could be made of a rectangularly shaped transparent material with a portion of said sheet having the indexing device included thereon. Alternately, the indexing device could be positioned on an adjacent sheet of material.

The probable cause/corrective action information sheets of the preferred embodiment have been described as being constructed of a plastic material. The primary reason for utilizing such material is its excellent wear characteristics. However, other sheet materials may also be utilized in the information retrieval apparatus of the present invention.

The information containing sheets of the information retrieval apparatus in the preferred embodiment of the present invention are pivotally attached to a support stand by a ring-type binder. Other suitable attaching means may be utilized so long as the proper sequence of information-containing sheets is maintained. If the sheets are placed on a shelf projecting outwardly from a support stand, there would be no necessity for attaching said sheets to said support stand. However, this arrangement would probably result in the information containing sheets being inadvertently placed in an improper sequence.

It will be apparent to those skilled in the art from the foregoing description of my invention that various improvements and modifications can be made in it without departing from its true scope. The embodiments described herein are merely illustrative and should not be viewed as the only embodiments that might encompass my invention.

What is claimed is:

1. Apparatus for providing rapid access to descriptive inforamtion relating to operator control of an operational system, said system having a plurality of indicators each of which respectively provide a visible indication of a different condition of the system, said indicators being arranged in a given spacial relation to each other so as to define a visible predetermined indicator pattern, said information access apparatus comprising:

a plurality of information sheets, each of said sheets respectively bearing an index area and descriptive information pertaining to a particular system condition indicated by a selected respective indicator such that each sheet thereby corresponds to a predetermined indicator; and means for mounting said information sheets with the index areas thereof spacially arranged to define a visible index pattern similar to said predetermined indicator pattern and with each index area being located within said index pattern in the same relative location as its respective system indicator is located in said indicator pattern such that the operator, upon viewing of a given system indicator and its relative position within said indicator pattern, is immediately aware of the corresponding information sheet and the descriptibe inforamtion thereon by virture of the correspondence in spacial position of said indicators and said index areas within their respective patterns.

2. The apparatus of claim 1, wherein each said index area resembles its corresponding indicator.

3. The apparatus of claim 2, wherein each said index area is identical to its corresponding indicator.

4. The apparatus of claim 1, wherein said index area of each information sheet is an index tab associated in an extended relation with its respective sheet, and said mounting means includes means for mounting said sheets for movement between a first, compact storage arrangement locating said index areas in said index pattern and a second arrangement providing direct view of the descriptive information on any index tab selected sheet.

5. The apparatus of claim 4, wherein said mounting means includes a support, said index tabs extend from one end of each sheet, and said sheets are pivotally attached at their other end to said support so that when said sheets are in their first arrangement, said tabs are arranged in said index pattern.

6. The apparatus of claim 1, wherein said indicator pattern is subdivided into a plurality of distinct, readily visible indicator groups with each indicator in each of said groups having a particular position with respect to other indicators in its indicator group, the said index pattern associated with said information sheets being subdivided into functionally related groups corresponding to the groups in said subdivided indicator pattern.

7. Apparatus for providing rapid access to descriptive information relating to operator control of an operational system, said system having a plurality of indicators each of which respectively provide a visible indication of a different condition of the system, said indicators being arranged in a given spacial relation to each other so as to define a visible predetermined indicator pattern, said information access apparatus comprising:

a plurality of information sheets, each of said sheets respectively bearing descriptive information pertaining to a particular system condition indicated a selected respective indicator such that each sheet thereby corresponds to a predetermined indicator;

an index area coupled to each of said information sheets such that each index area thereby corresponds to the predetermined indicator for that sheet; and means for mounting said information sheets for movement between a first, compact storage arrangement wherein essentially only said index areas are readily viewable and wherein review of said sheets is inhibited to a second arrangement providing direct view of a selected sheet upon selection of a desired index area, said mounting means including means for mounting said information sheets and said index areas thereof in said first arrangement such that said index areas define a visible index pattern similar to said predetermined indicator pattern with each index area being located within said index pattern in the same relative location as its corresponding indicator is located in its said indicator pattern such that the operator, upon viewing of a given indicator and its relative position within said indicator pattern, is immediately aware of the corresponding index area and its intercoupled information sheet with said descriptive information thereon by virture of the correspondence in spacial position between the given indicator and its corresponding index area within their respective patterns.

8. The apparatus of claim 7, wherein said indicator pattern is subdivided into a plurality of distinct, readily visible indicator groups with each indicator in each of said groups having a particular spacial position with respect to other indicators in its indicator group, the said index pattern associated with said information access apparatus being subdivided into functionally related group corresponding to the groups in said subdivided indicator patterns.

9. Apparatus for providing rapid access to descriptive information relating to operator control of an operational system, said system having a plurality of indicators each of which is operative to respectively provide a visible indication of a different condition of the system which requires action by the operator, said indicators being arranged in a given spacial relation to each other so as to define a visible predetermined indicator pattern, said information access apparatus comprising:

a plurality of information sheets, each of said sheets respectively bearing an index area and an information area, each said information area carrying descriptive information pertaining to a particular operator action required by the system condition indicated by a selected respective indicator such that the index area and information area of each sheet thereby corresponds to a predetermined indicator; and means for mounting said information sheets with the index areas thereof spacially arranged to define a visible index pattern substantially identical to said predetermined indicator pattern and with each index area being located within said index pattern in the same relative location as its respective indicator is located in said indicator pattern such that upon viewing of the relative position of any given indicator within said indicator pattern, the operator is immediately aware of the particular index area which corresponds to that given indicator by viture of the correspondence in spacial position of that given indicator within its indicator pattern and the position of the particular index area within its index pattern.

10. The apparatus of claim 9, wherein each said index area at least in part visually resembles its corresponding indicator.

11. The apparatus of claim 9, wherein said mounting means includes means for mounting said sheets for movement between a first, compact storage arrangement locating said sheets in an overlying position with said index areas forming said index pattern and a second arrangement providing direct view of any selected information sheet, and said index areas are index tabs associated in extended relation to said sheets and at selectively different relative locations thereto so that when said sheets are positioned in said compact arrangement, said index tabs form said index pattern.

12. The apparatus of claim 11, wherein said mounting means includes a support, said index tabs extend from one end of each sheet, and said sheets are pivotally attached at their other end to said support so that when said sheets are in their first arrangement, said tabs are arranged in said index pattern.

13. The apparatus of claim 9, wherein said indicator pattern is subdivided into a plurality of functionally related readily visibly distinguishable indicator groups with each indicator in each of said groups having a particular spacial position with respect to other indicators in its indicator groups, and said sheets being mounted such that said index pattern is subdivided into functionally related readily visibly distinguishable groups corresponding to the groups in said subdivided indicator pattern.

* * * * *